US009673576B2

(12) United States Patent
Ariani

(10) Patent No.: US 9,673,576 B2
(45) Date of Patent: Jun. 6, 2017

(54) SUPPORT FOR VARIOUS TYPES OF ITEMS

(71) Applicant: JOS TECHNOLOGY SRLS, Pontedera (IT)

(72) Inventor: Marco Ariani, Arsina (IT)

(73) Assignee: JOS TECHNOLOGY SRLS, Pontedera (IT)

( * ) Notice: Subject to any disclaimer, the term of this patent is extended or adjusted under 35 U.S.C. 154(b) by 0 days.

(21) Appl. No.: 14/892,828

(22) PCT Filed: May 22, 2014

(86) PCT No.: PCT/IB2014/061617
§ 371 (c)(1),
(2) Date: Nov. 20, 2015

(87) PCT Pub. No.: WO2014/188366
PCT Pub. Date: Nov. 27, 2014

(65) Prior Publication Data

US 2016/0149358 A1 May 26, 2016

(30) Foreign Application Priority Data

May 24, 2013 (IT) ..... PI2013A0044

(51) Int. Cl.
*H01R 13/74* (2006.01)
*H01R 13/62* (2006.01)
*H01R 9/28* (2006.01)

(52) U.S. Cl.
CPC ..... *H01R 13/74* (2013.01); *H01R 13/6205* (2013.01); *H01R 9/28* (2013.01)

(58) Field of Classification Search
USPC ..... 439/1, 559, 92, 104, 660, 544, 545
See application file for complete search history.

(56) References Cited

U.S. PATENT DOCUMENTS 3,327,173 A * 6/1967 Thompson ..... G09B 23/185 361/774
5,010,463 A * 4/1991 Ross ..... F21V 19/0025 362/234

(Continued)

FOREIGN PATENT DOCUMENTS

DE 1936991 A1 2/1971
DE 3842776 A1 7/1990

(Continued)

OTHER PUBLICATIONS

International Search Report mailed May 6, 2015, corresponding to International Application No. PCT/IB2014/061617.

*Primary Examiner* — Alexander Gilman
(74) *Attorney, Agent, or Firm* — Ladas & Parry LLP

(57) ABSTRACT

A system for managing electric devices, including a first panel having at least one hole and having a first conductive surface, a second panel integral and substantially parallel to the first panel and having a second conductive surface. The first panel is overlapped to the second panel. The system is configured in such a way that the second conductive surface has at least one portion not covered by the first panel and accessible through the, or each, hole. The first conductive surface and the second conductive surface are connected to an electric circuit in such a way that the first conductive surface has a first predetermined polarity, and the second conductive surface has a second predetermined polarity, opposite to the first predetermined polarity.

18 Claims, 11 Drawing Sheets

(56) References Cited

U.S. PATENT DOCUMENTS 5,543,586 A * 8/1996 Crane, Jr. ..... H01L 23/49811 174/260
5,772,469 A * 6/1998 Polgar ..... H01R 13/74 439/546
6,450,834 B1 * 9/2002 Polgar ..... H01R 13/74 439/247
6,657,381 B1 * 12/2003 Arutaki ..... G09F 9/33 313/512
6,697,257 B1 * 2/2004 Wolf ..... H01L 23/5385 174/252
6,708,404 B1 * 3/2004 Gaku ..... H05K 3/0038 216/17
7,084,512 B2 * 8/2006 Higashida ..... H01L 23/5387 257/678
7,442,045 B1 * 10/2008 Di Stefano ..... H01R 4/027 439/439
7,665,883 B2 * 2/2010 Matheson ..... F21V 21/0824 362/640
7,802,906 B2 * 9/2010 Goto ..... B60Q 3/0203 362/147
8,007,309 B2 * 8/2011 Fan ..... H01R 13/74 439/376
8,422,247 B2 * 4/2013 Kameyama ..... H01R 13/506 174/258
8,525,402 B2 * 9/2013 Aeling ..... F21V 19/0025 313/498
8,704,972 B2 * 4/2014 Jang ..... H01R 12/721 349/58
8,740,409 B2 * 6/2014 Nakata ..... H01L 33/62 362/249.02
8,894,419 B1 * 11/2014 Buelow ..... H01R 13/6205 439/218
8,907,354 B2 * 12/2014 Ingle ..... H01L 51/5203 174/262
9,088,097 B2 * 7/2015 Kim ..... H01R 13/6205
2004/0232536 A1 * 11/2004 Fukuzumi ..... H01L 23/057 257/684
2009/0086478 A1 * 4/2009 Sanroma ..... A47F 3/001 362/234
2010/0157194 A1 * 6/2010 Kim ..... H01R 33/02 349/61
2010/0317233 A1 * 12/2010 Koh ..... H01R 13/22 439/626
2013/0044501 A1 * 2/2013 Rudisill ..... F21V 29/70 362/398
2014/0193985 A1 * 7/2014 Wang ..... H01R 43/007 439/66

FOREIGN PATENT DOCUMENTS

IT 2009FI00085 4/2009
KR 20110120483 A 11/2011
WO 2009082181 A2 7/2009

* cited by examiner

Fig. 1
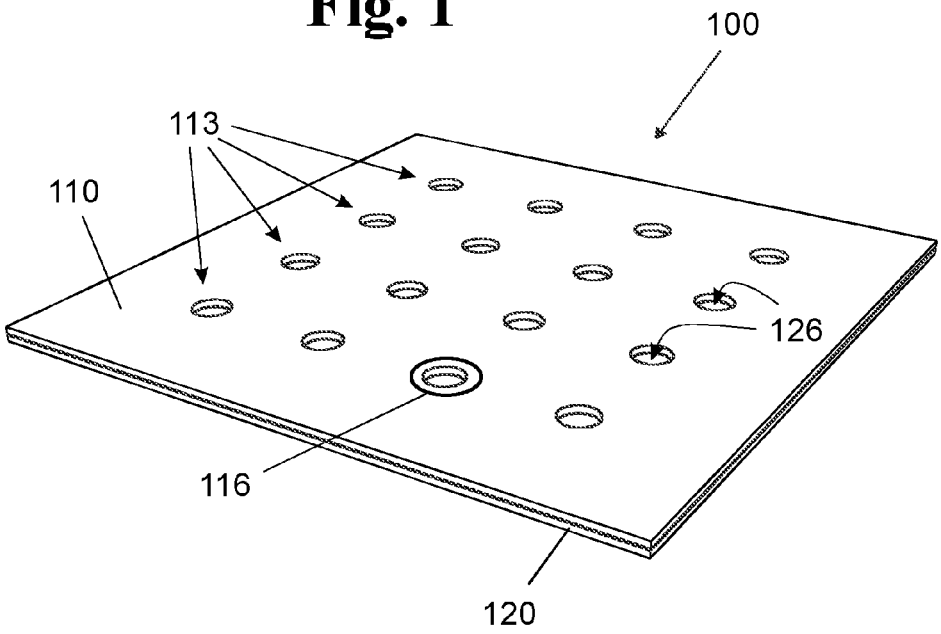
Fig. 2A
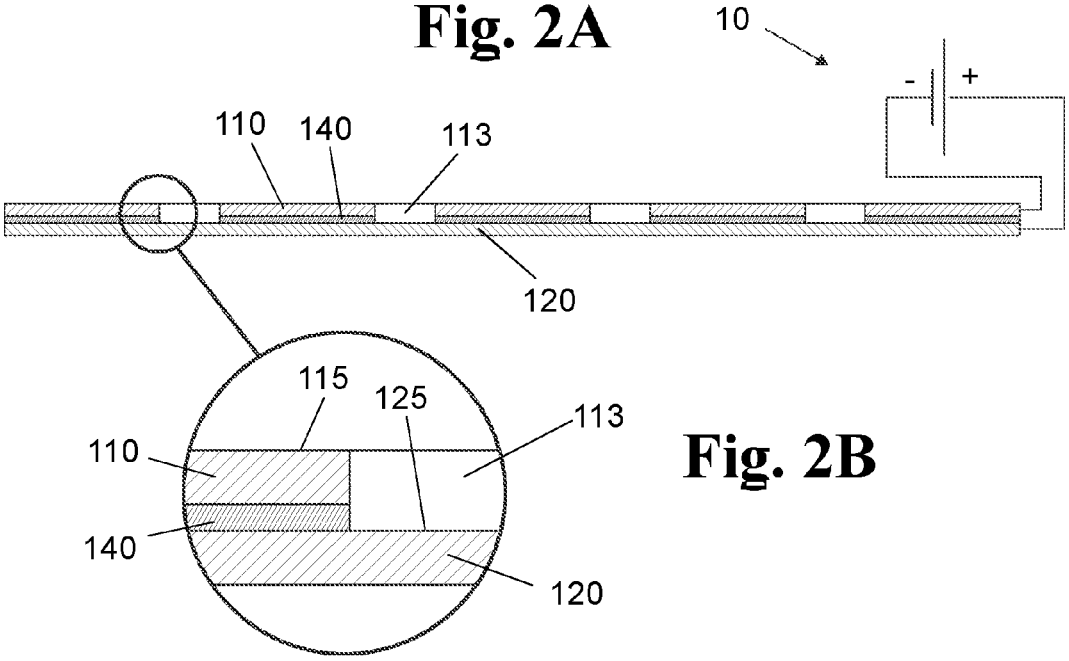
Fig. 2B

Fig. 5A
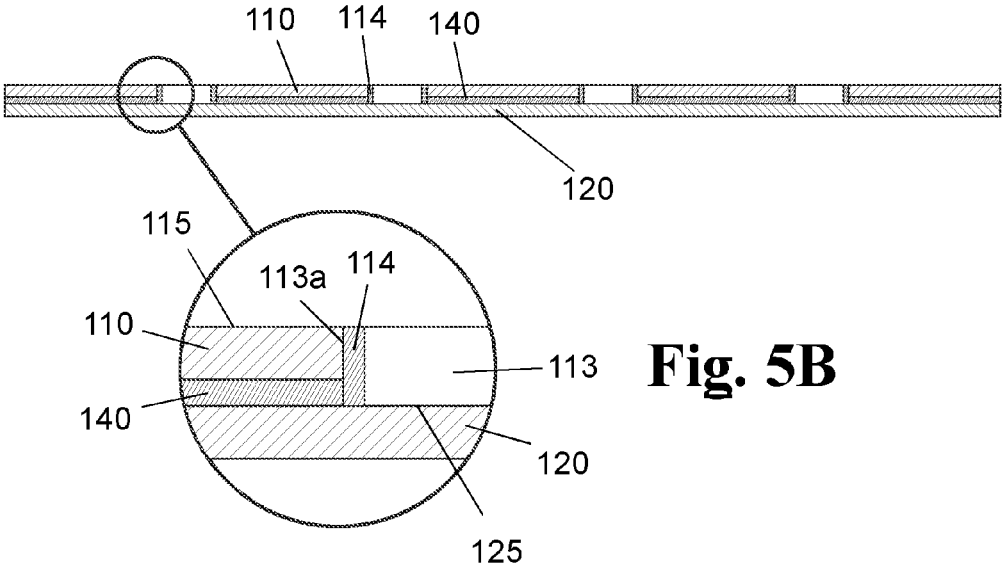
Fig. 5B
Fig. 6A
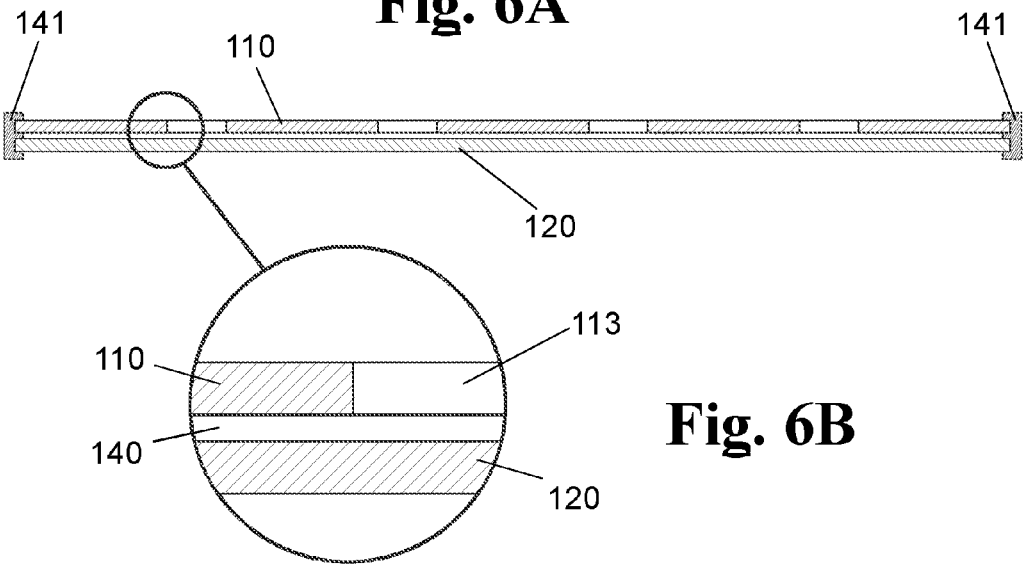
Fig. 6B

Fig. 7A
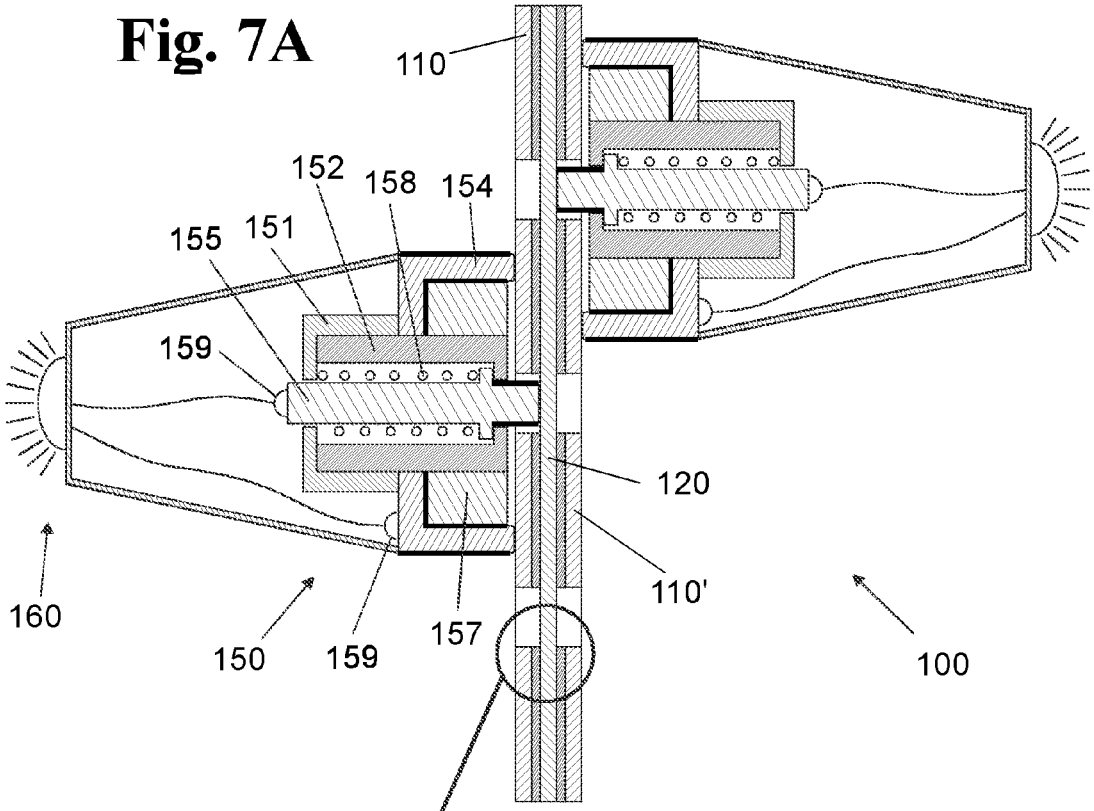
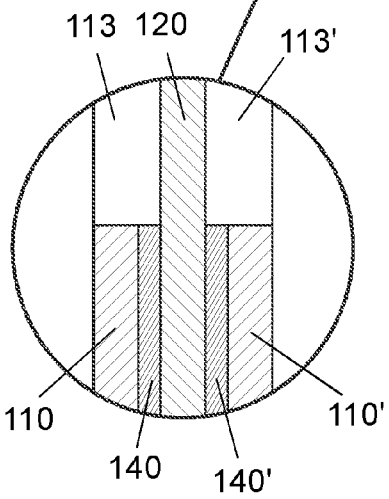
Fig. 7B

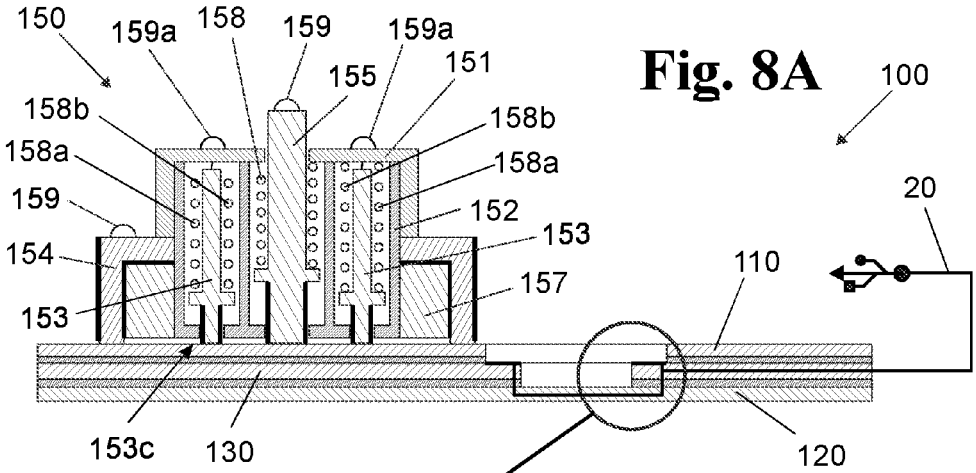
Fig. 8A
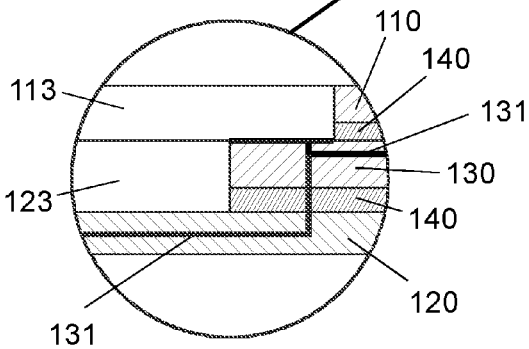
Fig. 8B
Fig. 8C
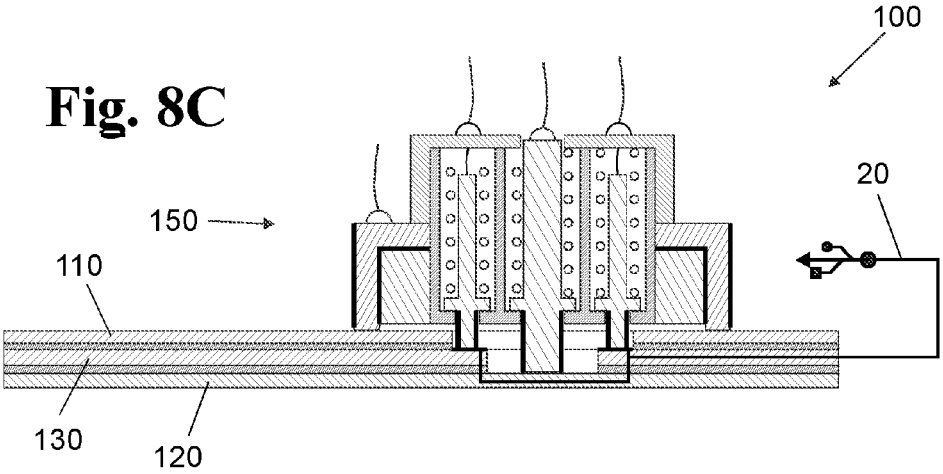

SUPPORT FOR VARIOUS TYPES OF ITEMS

This application is a 371 of PCT/IB2014/061617, filed on May 22, 2014, which claims priority to Italian Application No. PI2013A000044, filed May 24, 2013.

FIELD OF THE INVENTION

The present invention relates to the easy connection of electric devices to an electric network and/or a data transmission network.

In particular, the invention relates to the easy connection of electric devices such as, for example, LED lights, battery chargers, or electronic devices.

DESCRIPTION OF THE PRIOR ART

Systems exist of electric lighting, as shown for example in IT2009F100085, which allow an easy connection of LED electric devices to a sandwich-structured panel connected to the electric network.

In particular, in the cited document the sandwich-structured panel comprises two metal panels separated by an insulating panel. In one of the two metal panels holes are provided that allow the introduction of cylindrical plugs connected to the above described electric devices. The connection to the electric network allows the two metal panels to have opposite polarities and to supply the cylindrical plugs in the holes, allowing the LED lights to turn on.

However, this system has various functional drawbacks and drawbacks of safety.

Firstly, the insulating panel is made of plastic material or wood. These materials, stiff itself, require also a high thickness to ensure an appropriate insulation, stiffening further the structure. Therefore, the sandwich-structured panel does not present any flexibility and does not allow to be fitted to irregular surfaces or to be shaped in predetermined shapes. Furthermore, in order to keep the panels together, an external frame is necessary that provides further stiffness to the structure, and complicates structurally the production of the system.

Another critical point is the electric insulation in the holes. In these points, in fact, the metal panels are very closed to each other and have both their own conductive surfaces exposed. To this purpose the invention provides an insulating layer around the jack of the cylindrical plug, in order to avoid that a wrong introduction of the plug in the sandwich panel can cause the system to short-circuit. This solution, however, is only partial and does not avoid the possibility of a short-circuit due to the introduction in the holes of conductive objects or liquids.

A further functional problem is that the conductivity between the plug and the perforated panel is due to a little metallic wire that continuously scrapes on the panel. The metallic wire makes instable the attack of the plug and, especially, with the use it risks to break and to get in touch with the lower panel causing a short-circuit. In addition, the invention provides that the jack is connected to a copper wire that is forced to pass through the spring. However, when the spring is in compression the wire could go between the coils of the spring, risking the breaking of the wire, or in any case risking to jeopardize the correct operation of the system.

Finally, a further drawback of the above described invention is that only exclusively electric devices can be connected to the cylindrical plugs. It is not therefore possible a data connection of devices (flash memories, hard disks, smartphones, etc.) to a network of data transmission connected to a computer, or other devices.

Another example of system for managing electric devices is shown in US2013044501.

With reference to FIG. 53, also US2013044501 provides an insulating layer 165 around the "protruding contact" 164, in order to avoid the electric contact between the apertures 153. However, analogously to IT2009F100085, this solution doesn't avoid the possibility of a short-circuit due to the introduction in the holes of conductive objects or liquids, in addition to the possibility of short-circuits due to a wrong introduction of the "protruding contact" 164.

Furthermore, US2013044501 doesn't explicitly describe exemplary embodiments that show a possible inventive solution for data transmission.

SUMMARY OF THE INVENTION

It is therefore a purpose of the present invention to provide a system for managing electric devices that provides an appropriate safety standard, preventing from short circuiting the electric plant.

It is also a purpose of the present invention to provide such a system that is versatile and adaptable for the installation in different locations and also on not flat surfaces.

It is still a purpose of the present invention to provide such a system that solves the above mentioned functional problems, improving the simplicity and the use efficiency for a user.

It is a further purpose of the present invention to provide such a system that allows a data connection of devices, such as flash memories, hard disk, smartphones, or other, to a network of data transmission connected to a computer, or to other devices, or to Internet.

It is also a purpose of the present invention to provide such a system that allows a speed of data transmission equal to a USB port, and a quick charge of USB devices.

These and other purposes are achieved by a system for managing electric devices comprising:

- a first panel having at least one hole and having a first conductive surface defined at least in a neighbouring area of the or each hole;
- a second panel integral and substantially parallel to the first panel, the second panel having a second conductive surface, the first panel being overlapped, in use, to the second panel.

In particular, the system is configured in such a way that the second conductive surface has at least one portion not covered by the first panel and accessible through the or each hole of the first panel. The first conductive surface and the second conductive surface are connected to an electric circuit in such a way that the first conductive surface has a first predetermined polarity, and the second conductive surface has a second predetermined polarity, opposite to the first predetermined polarity.

The system for managing electric devices also comprises at least one electric connection member which is adapted to electrically connect the first conductive surface and the second conductive surface to an electric device, in order to close the electric circuit and electrically supply the electric device.

According to what provided by the present invention, the system for managing electric devices provides that the first and the second panel are made of electrically conductive material and that the or each hole of the first panel is laterally defined by a wall electrically connected to the first conductive surface. In this case, it is advantageously provided that the wall of the or each hole of the first panel is coated by a layer in insulating material arranged to avoid that the above described wall and the second conductive surface are accidentally electrically connected causing the short circuit of the electric circuit. This way, the safety of the system is increased avoiding that the electric connection member, leaning during the introduction in or the extraction from a hole, can short-circuit the electric circuit. Furthermore, on the contrary of what is carried out in the prior art, it is prevented that this short circuit can be carried out by conductive objects or liquids that accidentally penetrate in the holes of the first panel.

According to what provided by another aspect of the present invention, the system for managing electric devices provides that a first portion of the first panel and/or a second portion of the second panel has at least one data transmission line connected to a data circuit. In particular, the data transmission line is arranged to be connected with the or each electric connection member, in such a way to allow a data transfer between the data circuit and the or each electric user.

This way, an electric device arranged to receive and/or transmitting data, for example a flash memory, a hard disk, a smartphone, a tablet, or other, can be associated with an electric connection member arranged for the data transmission, in such a way to share data with the data circuit, which in turn can be connected, for example, to the USB port of a computer or to Internet. Furthermore, it is possible to connect, with the same system, two or more electric devices at the same time, so that they can transmit data to each other and/or to the data circuit, and at the same time being electrically supplied.

Advantageously, the insulating element is an insulating glue arranged to constrain the first and the second panel, in such a way to make one integral to the other and to arrange them close to each other. In particular, the first and the second panel are arranged, in use, at a predetermined distance one from the other, advantageously smaller than the thickness of each panel, preferably smaller than the thickness of half panel. This way, the system has a high flexibility, in particular since the layer of insulating element has a thickness very small with respect to the solutions of the prior art and, at the same time, it does not require the presence of an external structure that make integral each other the first and the second panel. Thanks to this high flexibility, it is possible to install the system on non-planar surfaces, or not perfectly regular surfaces, and then adapting the shape of the system to the different needs. In particular, it is possible to install the system on vehicles, adapting the panels to the typically curved shape of the dashboard.

In an exemplary embodiment of the present invention, the first and the second panel are kept integral each other by a frame. In this case, the insulating element between the two panels simply consists of a layer of air. Such solution is much cheaper than the previous, since the cost of the insulating material is saved. Furthermore, the frame makes easier installing the panels on a wall, or locating them in a support plane, for example on a desk.

Advantageously, the electric circuit of the system for managing electric devices is connected to a plant for generating energy by means of solar radiation, in order to supply the or each electric device even without a traditional source of electric supply.

Advantageously, a third panel is provided comprising a plurality of holes and integral to the second panel. In particular, the third panel is located opposite to the first panel with respect to the second panel, in order to allow a connection of the or each electric connection member on both the sides of the second panel. Such solution is particularly advantageous for using the system as a vertical separé, or as a shelf, increasing the surface to which it is possible to connect the electric devices.

Advantageously, at least a fourth panel is provided arranged in parallel to the first and to the second panel and comprising at least one hole having a diameter that is smaller than the diameter of the or each hole of the first panel. More in detail, the or each fourth panel comprises at least one data transmission line connected to a data circuit, said data transmission line arranged to be connected with the or each electric connection member, in such a way to enable a data transfer between the data circuit and the or each electric device.

In particular, at least one among the first panel, the second panel, the third panel and the fourth panel has at least one portion of magnetisable material, or ferromagnetic material, and the electric connection member comprises a magnet, or an electromagnet, or a ferromagnetic element. This way, a magnetic, or electromagnetic, field is created arranged to constrain the electric connection member to at least one of said panels.

Alternatively, the panels are completely made of not ferromagnetic material, for example plastic, and the electric connection member can be constrained to the panels by means of, for example, a screw system, a bayonet coupling, a fixed joint, or similar. Such solution has the advantage to decrease the weight of the whole system and to make safer the constraint with respect to the use of a magnet, in particular in case that the system has to endure strong accelerations. Furthermore, the present exemplary embodiment avoids potential detrimental interferences between the magnetic field produced by the magnet and the electric field of the data transmission circuit.

Advantageously, a network of an electrically conductive material, for example copper, is provided which is located above and/or below the transmission data panel to limit or eliminate detrimental interferences between the magnetic field produced by the magnet and the electric field of the data transmission circuit.

In particular, the electric connection member comprises:

- a first conductor arranged, in use, to be connected with the first conductive surface;
- a second conductor arranged to enter in the or in each hole for arranging, in use, in contact with the second conductive surface;
- in such a way to electrically connect the electric device to the electric circuit.

Advantageously, each electric connection member comprises a support structure and the second conductor is slidingly mounted with respect to the support structure.

Advantageously, each electric connection member comprises a layer of elastic material at the portion in contact with the first panel. This way, the connecting element is much more adherent to the panel, avoiding to move or rotate by gravity or by involuntary small forces.

In particular, is also provided an elastic element arranged to apply an elastic force on the second conductor for causing a translation of the second conductor with respect to the support structure and causing the introduction of the second conductor in the or in each hole for arranging it in contact with the second conductive surface.

Advantageously, each electric connection member also comprises a third conductor arranged to connect to the transmission data line to allow that the electric device can transmit and/or receive data with said data circuit.

In particular, each electric connection member has a cavity arranged to house the second conductor and to insulate it by the first conductor. Furthermore, the support structure of the connecting element has a support portion on which rests an enlarged portion of the second conductor.

Advantageously, each electric connection member comprises a conductor arranged to connect to the or to each data transmission line on the first panel and/or on the second panel, to allow that the electric device can transmit and/or receive data with the data circuit.

In particular, the first panel comprises a plurality of holes, and the first conductive surface consists of a plurality of portions, each of which lays in a neighbouring area of a hole of the plurality.

Advantageously, each electric device is selected from the group consisting of:

- an electronic device in very low voltage;
- a device for lighting (CFL, LED, OLED);
- a portable device (smartphone, tablet, notebook);
- a traditional battery charger and/or an induction battery charger;
- a device supplied by means of USB port or microUSB port or miniUSB port;
- a device for data transmission (RGB light, flash memory, USB device, system DALI, hard disk);
- a device supplied in average voltage by means of an inverter.

BRIEF DESCRIPTION OF THE DRAWINGS

Further characteristic and/or advantages of the present invention are more bright with the following description of some exemplary embodiments, exemplifying but not limitative, with reference to the attached drawings in which:

FIG. 1 shows a perspective view of a first exemplary embodiment, according to the invention, of the first and of the second panel, and of the insulating material;

FIG. 2A shows a cross sectional view of the exemplary embodiment of FIG. 1 of the first and of the second panel, and of the insulating material;

FIG. 2B shows a detail of FIG. 2A;

FIG. 5A shows a cross sectional view of a further exemplary embodiment of the first and of the second panel and of the insulating material;

FIG. 5B shows a detail of FIG. 5A;

FIG. 6A shows a cross sectional view of another exemplary embodiment of the first and of the second panel, wherein an external frame is provided;

FIG. 6B shows a detail of FIG. 6A;

FIG. 7A shows a cross sectional view of a further exemplary embodiment of the system for managing electric devices, according to the invention, where the electric devices can be connected on both sides of the second panel;

FIG. 7B shows a detail of FIG. 7A;

FIG. 8A shows a cross sectional view of another exemplary embodiment of the system for managing electric devices, according to the invention, wherein a further panel with a data transmission line is provided, and where the electric connection member is not centred in a hole;

FIG. 8B shows a detail of FIG. 8A;

FIG. 8C shows a cross sectional view of an exemplary embodiment of the system for managing electric devices of FIG. 8A, where the electric connection member is centred in a hole;

DESCRIPTION OF A PREFERRED EXEMPLARY EMBODIMENT

Figure 3:
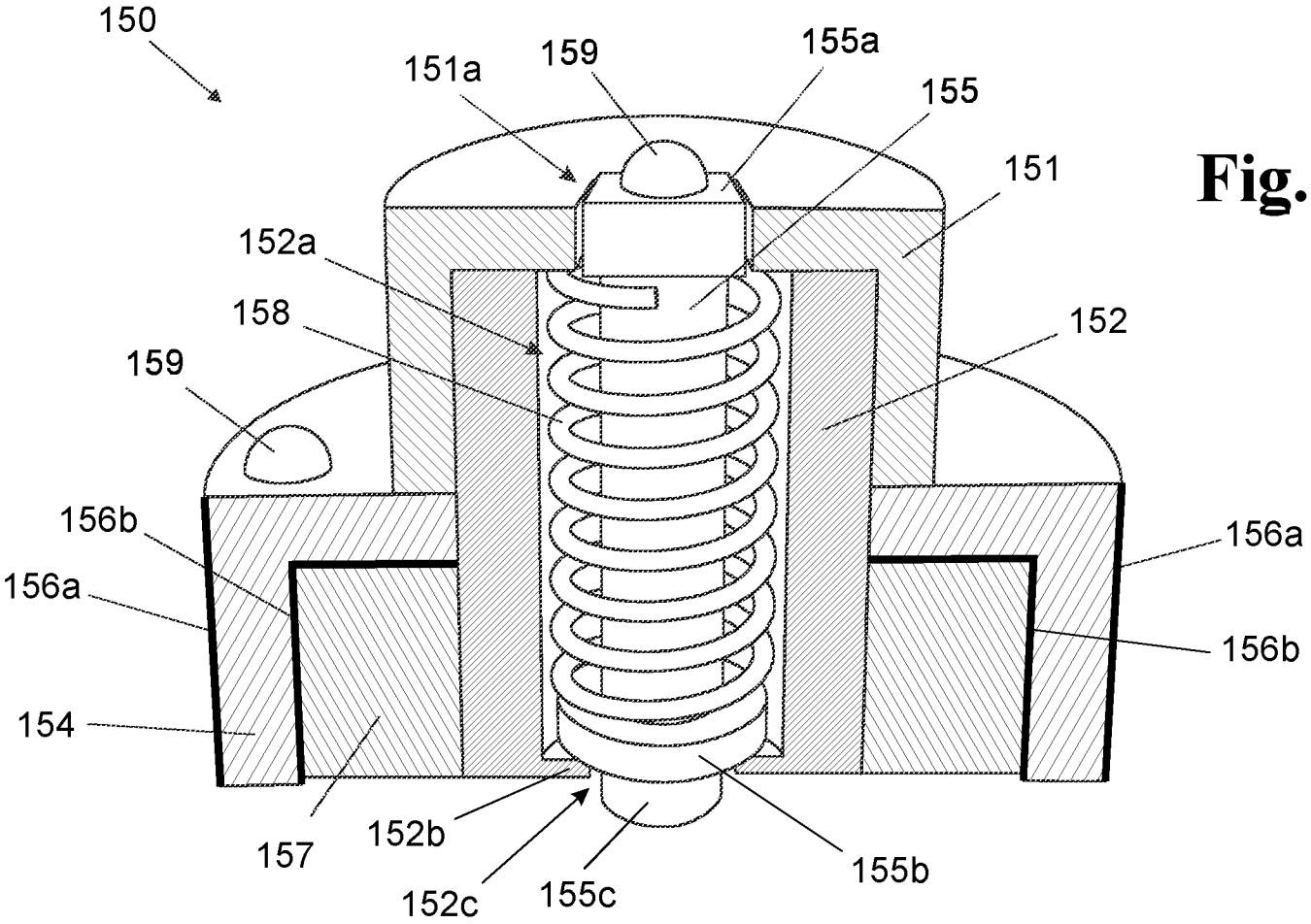
FIG. 3 shows a perspective view of a first exemplary embodiment, according to the invention, of the electric connection member.

With reference to FIGS. 1, 2A and 2B, in a first exemplary embodiment, the system 100 for managing electric devices, according to the invention, comprises a first panel 110 having a plurality of holes 113, and a second panel 120, parallel to the first panel 110. The two panels 110 and 120 have respective conductive surfaces 115 and 125 of electrically conductive material.

In particular, the panels 110,120 can be made of and/or superficially coated by electrically conductive material. In detail, the conductive surface 115 can cover integrally the panel 110, or being split into portions 116 arranged in predetermined zones of the panel 110, in particular in a neighbouring area of the holes 113. In FIG. 1 is schematically shown, as example, a portion 116 in a neighbouring area of a hole 113. However, is provided the possibility of having conductive portions 116 arranged on the panel 110 according to a predetermined layout. This layout can provide a predetermined number of portions 116 having a predetermined size and extending in the neighbouring area of at least one hole 113.

Like the conductive surface 115, also the conductive surface 125 can cover integrally the panel 120, or being split into portions 126 localized at the holes 113. In both cases, the overlap of the two panels 110 and 120 leaves uncovered the portions 126 of the surface 125, which are accessible from the outside through the holes 113.

The panels 110 and 120 are connected to an electric circuit 10 that provides opposite polarity to the two conductive surfaces 115 and 125.

In the present exemplary embodiment between the two panels 110,120 an insulating element 140 is located that prevents from a short circuit of the circuit 10. Such insulating element 140 can be a gluing substance that, besides to insulate the panels 110 and 120, also allows to keep them integral and close each other. In particular, the technical solution used reduces the thickness of the insulating element 140 with respect to other solutions of the prior art, such as panels of material not electrically conductive. For example, for panels 110,120 of about 1 mm of thickness, satisfactory results are obtained with a thickness of the insulating element 140 of 0.2-0.3 mm.

Furthermore, the reduced thickness of the insulating material allows to use panels 110,120 of flexible material, in such a way to allow an installation of the system 100 on non-planar surfaces, or not perfectly regular surfaces, and then adapting the shape of the system 100 to the different needs. In particular, it is possible to install the system 100 in vehicles, adapting the panels to the typically curved shape of the dashboard.

In any case, it is provided by the present invention also the possibility to use as insulating material 140 any desired material able of avoid the electric connection of the panels 110,120. In particular, a cheap solution uses polystyrene as insulating material. Such material is also particularly sound absorbing, causing the system 100 to be suitable for be used, for example, as separé, or as soundproofing element. In this case, for increasing the acoustic insulation produced by the system 100, a further panel of sound absorbing material can be provided located next to the panel 120.

Figure 4A:
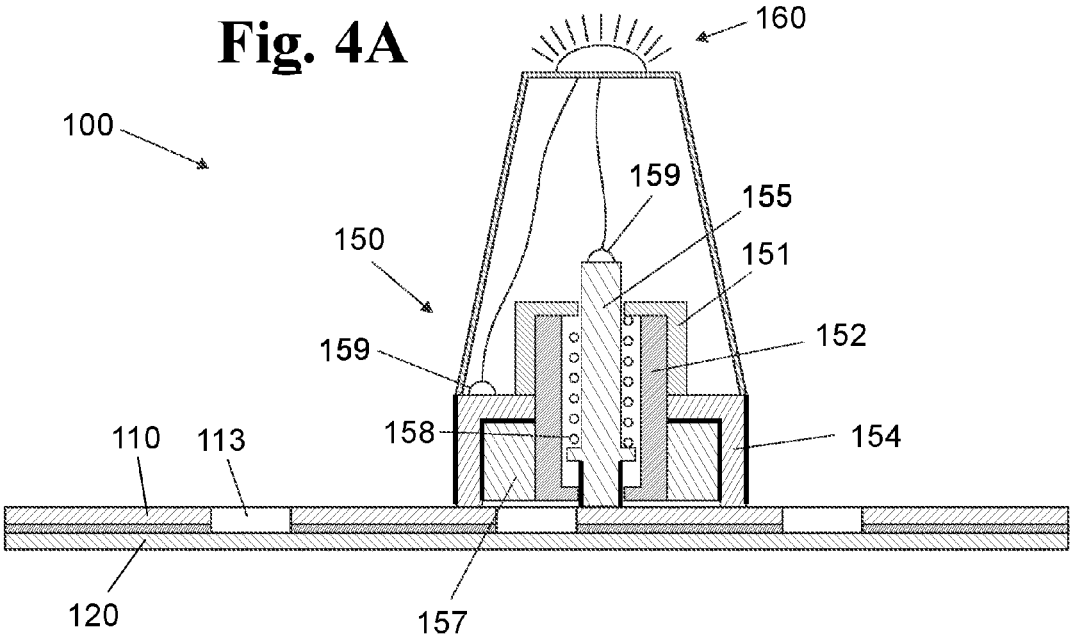
FIG. 4A shows a cross sectional view of an exemplary embodiment of the system for managing electric devices, according to the invention, where the electric connection member is not centred in a hole.
Figure 4B:
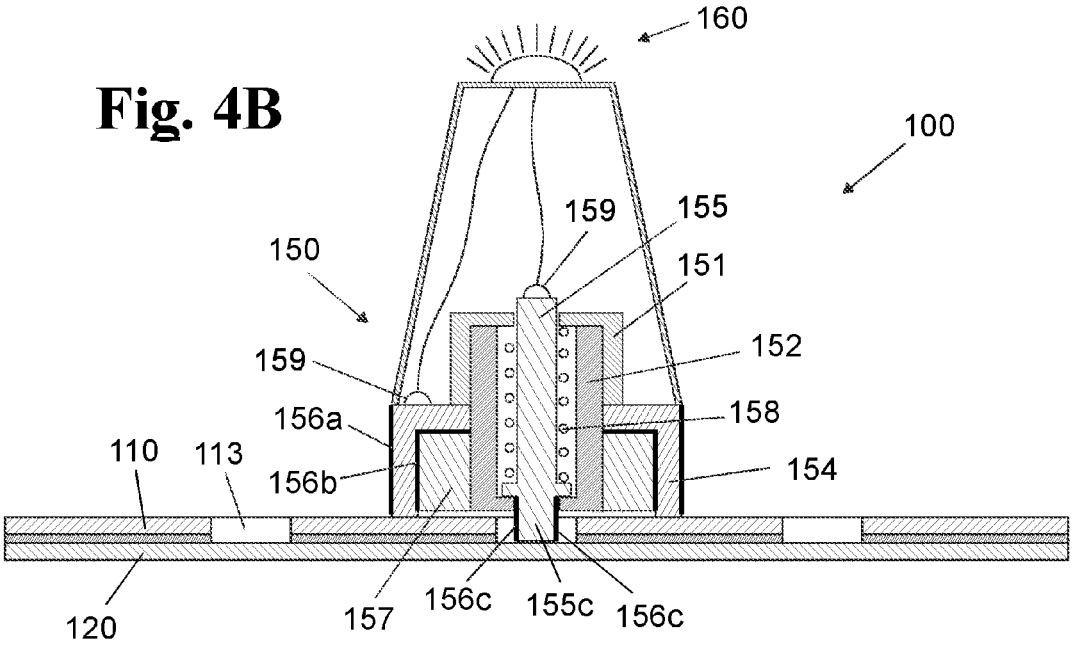
FIG. 4B shows a cross sectional view of an exemplary embodiment of the system for managing electric devices of FIG. 4A, where the electric connection member is centred in a hole.

With reference to FIGS. 3, 4A and 4B, the system 100 also comprises an electric connection member 150 that connects the two conductive surfaces 115 and 125, closing the electric circuit 10 and allowing the supply of an electric device 160, for example a LED light in FIGS. 4A and 4B.

In particular, the electric connection member 150 comprises a first conductor 154, a second conductor 155, a support structure 152 and a cover 151.

As shown in FIG. 3, the support structure 152, for example substantially cylindrically shaped, has a cavity 152*a* arranged to house the second conductor 155 and to insulate it by the first conductor 154. In particular, the support structure 152 has a support portion 152*b* on which an enlarged portion 155*b* of the second conductor 155 rests.

The electric connection member 150 also comprises a spring 158 that produces an elastic force on the second conductor 155, in such a way to cause a portion 155*c* to exit from the cavity 152*a* of the support structure 152 through an opening 152*c*.

In the exemplary embodiment of FIGS. 4A and 4B the panel 110 and/or the panel 120 are composed by magnetizable, or ferromagnetic, material and the electric connection member 150 comprises a magnet 157 arranged to magnetize the panel 110 and/or the panel 120, in order to apply a magnetic force that constraints the element 150 to the panels.

As shown in FIG. 4A, when the electric connection member 150 is located on the panel 110, it is constrained, thanks to the above described magnetic force. if the second conductor 155 is not located at a hole 113, the spring 158 is compressed and the device 160 is not electrically supplied.

With reference to FIG. 4B, displacing the electric connection member 150 on the surface of the panel 110, when the second conductor 155 is arranged at a hole 113, portion 155*c* protrudes, thanks to the spring 158, outside of the cavity 152*a* through the opening 152*c*.

In this situation, the second conductor 155 touches the conductive surface 125 on the panel 120, and in particular with one of the portions 126 not covered. The first conductor 154 remains in contact with the conductive surface 115 on the panel 110. This way, the electric device 160, electrically connected to the two conductors 154 and 155 by two interface 159, for example two welding points, closes the circuit 10 and is electrically supplied.

To avoid that the wires that connect the electric device 160 and the welding points 159 twist each other, risking to break, the conductor 155 may have a head square section 155*a*, visible in FIG. 3, that is arranged to move through the hole 151*a* obtained in the cover 151. This way, it is prevented the relative rotation between cover 151 and the conductor 155 when the conductor 155 translates, entering or exiting from the holes 113.

To electrically insulate the conductor 154, a cover with some layers of insulating material is provided. In particular, there is a layer of insulating material 156*a* that insulates the conductor 154 on all its outer surface, in order to prevent that a user, or any object, can be contact with the conductor 154 when it is crossed by electric current. Another layer of insulating material 156*b* is located on the inner surface of the conductor 154, in order to avoid an electric contact with the magnet 157, and avoid interferences in the electric circuit.

Furthermore, the support structure 152 and the cover 151 can be made in insulating material, in such a way to avoid the indirect electric contact between the two conductor 154 and 155 and between the conductor 155 and the magnet 157.

As shown in FIGS. 4A and 4B, in this exemplary embodiment the conductor 154 protrudes towards the panels 110, 120 more than the magnet 157, in order to avoid the contact between the magnet 157 and the panels. Alternatively, the magnet 157 can be covered by a further insulating layer also in the lower part to avoid the contact with the panels 110,120.

Furthermore, if the panels 110 and 120 are made or coated with conductive material also at the inside of the holes 113, an exemplary embodiment of the present invention provides that portion 155*c* of the conductor 155 is coated by a layer of insulating material 156*c* (see FIG. 4B). More in detail, the insulating material 156*c* prevents that the conductive surface 115 of the panel 110 is accidentally electrically connected to the conductive surface 125 of the panel 120, causing the short-circuit of the circuit 10. With reference to FIGS. 5A and 5B, another possible solution to the problem of an accidental short-circuit of the circuit 10 provides that the wall 113*a* delimiting each hole 113 is coated with a layer of insulating material 114. In this case, unlike the prior art, it is possible to avoid also a short circuit due to the wrong introduction of conductive objects or liquids in the holes 113.

With reference to FIGS. 6A and 6B, a possible exemplary embodiment of the invention provides that the panels 110 and 120 are kept integral each other by a frame 141, and that the insulating element 140 that insulates the two panels consists of an air layer. Such solution is much cheaper than the previous, since is the cost of the insulating material is saved. Furthermore, the frame 141 makes easier installing the panels 110,120 on a wall, or locating them in a plane support, for example on a desk.

With reference to FIGS. 7A and 7B, in a further exemplary embodiment of the invention, a third panel 110' is provided having a plurality of holes 113' and being integral to the panel 120. The panel 110' is located at the opposite side respect to the panel 110, and essentially it has the same functions, so that the electric devices can be connected at both the sides of the panel 120.

With reference to FIGS. 8A, 8B and 8C, a further exemplary embodiment of the invention provides a fourth panel 130 located between the panels 110 and 120 and comprising at least one data transmission line 131 connected to a data circuit 20.

In particular, the fourth panel 130 also is provided with a plurality of holes 123, which have a smaller diameter than the holes 113 on the panel 110, in order to allow that an electric connection member 150 can be in contact with all the three panels 110, 120 and 130.

More in detail, in this exemplary embodiment the electric connection member 150 comprises a third conductor 153 arranged to connect to the data transmission line 131, in order to allow that the electric device 160 can transmit data with the data circuit 20.

Similarly to the second conductor 155, the third conductor 153 is associated with at least one spring, for example two springs 158*a* and 158*b* arranged at opposite sides with respect to it, and arranged to elastically force the third conductor 153 to protrude from the support structure 152 through at least one opening 153*c*. As schematically shown for example in FIG. 8A, the third conductor 153 may have a substantially cylindrical geometry and surround, in use, the second conductor 155, and the opening 153*c* may be substantially ring shaped.

In particular, when the connecting element 150 is centred in a hole 113, the second conductor 155 is pushed by the spring 158 to contact the conductive surface 125, whereas the third conductor 153 is pushed by the springs 158*a* and 158*b* to contact the data transmission line 131 on the panel 130.

The data transmission line 131 is also split into two branches, allowing the conductor 153 to connect to two different data channels. A first part of the conductor 153 (for example the right part in FIG. 8A) can be connected to a first data channel, whereas the other part of the conductor 153 (for example the left part in FIG. 8A) can be connected to the second data channel. The two data channels are then connected to the electric device 160 by two interface elements 159*a*. To assist the fastening of the connecting element 150 and to prevent that the data channels can be reversed each other, an exemplary embodiment of the present invention provides that the holes 113 have a cross section substantially half moon shaped, and that the conductor 153 has the same shape.

In particular, a device 160 arranged to receive and/or transmitting data, for example a flash memory, an hard disk, a smartphone, a tablet, or other, can be associated with an electric connection member 150 arranged for the data transmission, in such a way to transmit data to the data circuit 20, which in turn can be connected, for example, to a USB port of a computer or to Internet. This way, the device 160 can both being electrically supplied by the panels 110 and 120, and transmitting data at a speed of a USB device thanks to the panel 130. With respect to a common USB port the charging speed of the device is much higher, since it is the same that you would have connecting the device directly to the electric current. Furthermore, it is possible to connect, with the same system, two or more devices 160 at the same time, so that they can transmit data to each other and/or to the data circuit 20, and being supplied at the same time.

Figure 9A:
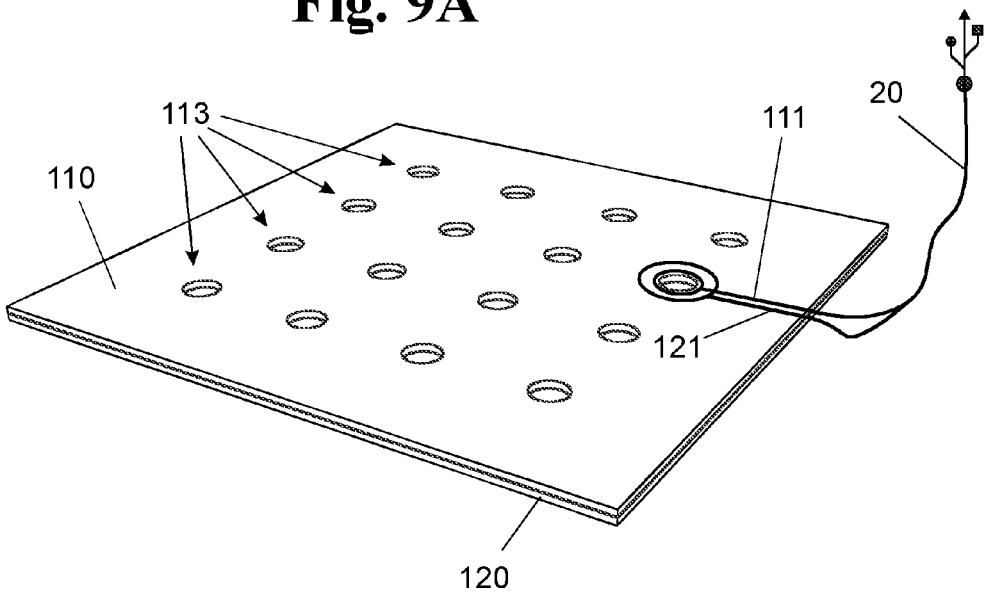
FIG. 9A shows a perspective view of an exemplary embodiment of the system of FIG. 1, wherein a data transmission line on the first panel is provided.
Figure 9B:
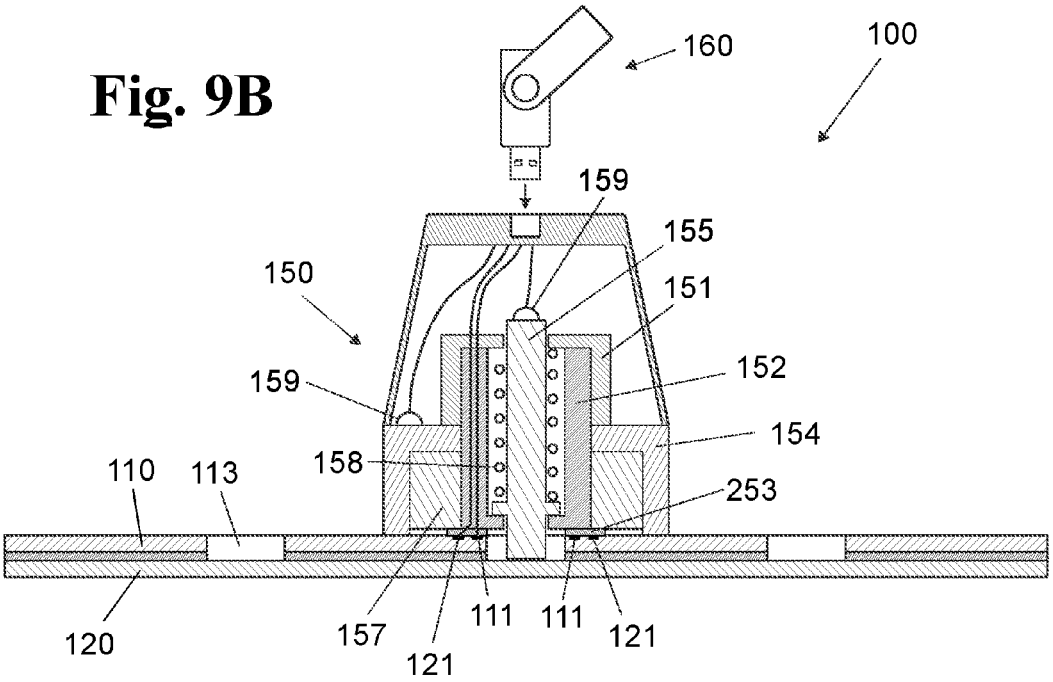
FIG. 9B shows a cross sectional view of an exemplary embodiment of the system for managing electric devices comprising the panels shown in FIG. 9A.
Figure 10A:
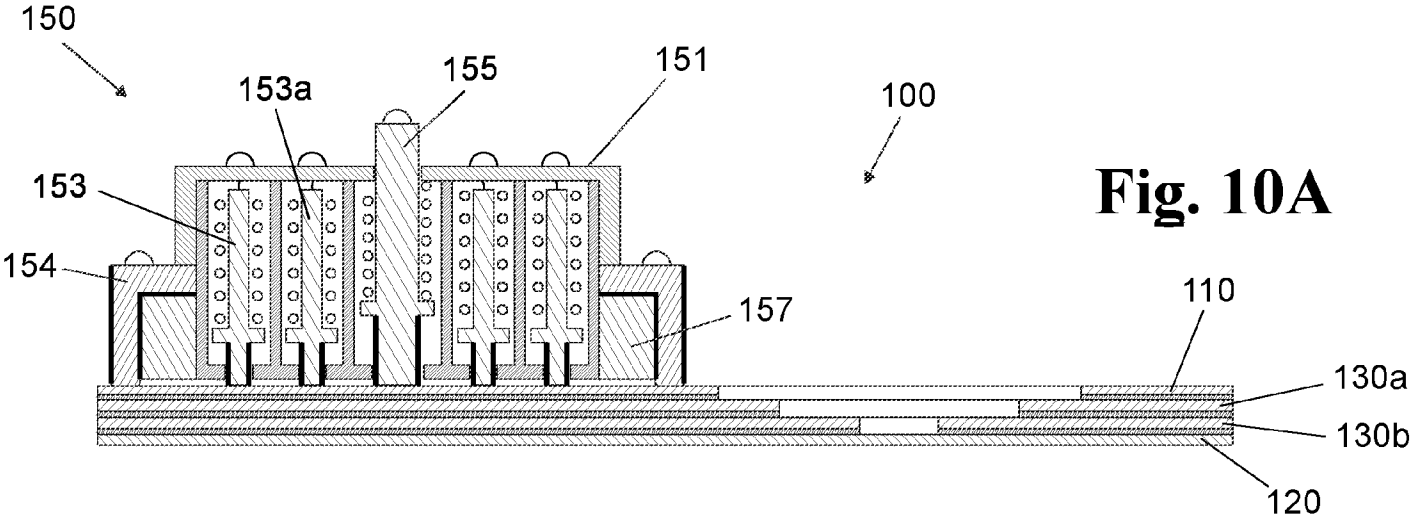
FIG. 10A shows a cross sectional view of an exemplary embodiment of the system for managing electric devices, according to the invention, wherein a further panel for data transmission is provided, and where the electric connection member is not centred in a hole.
Figure 10B:
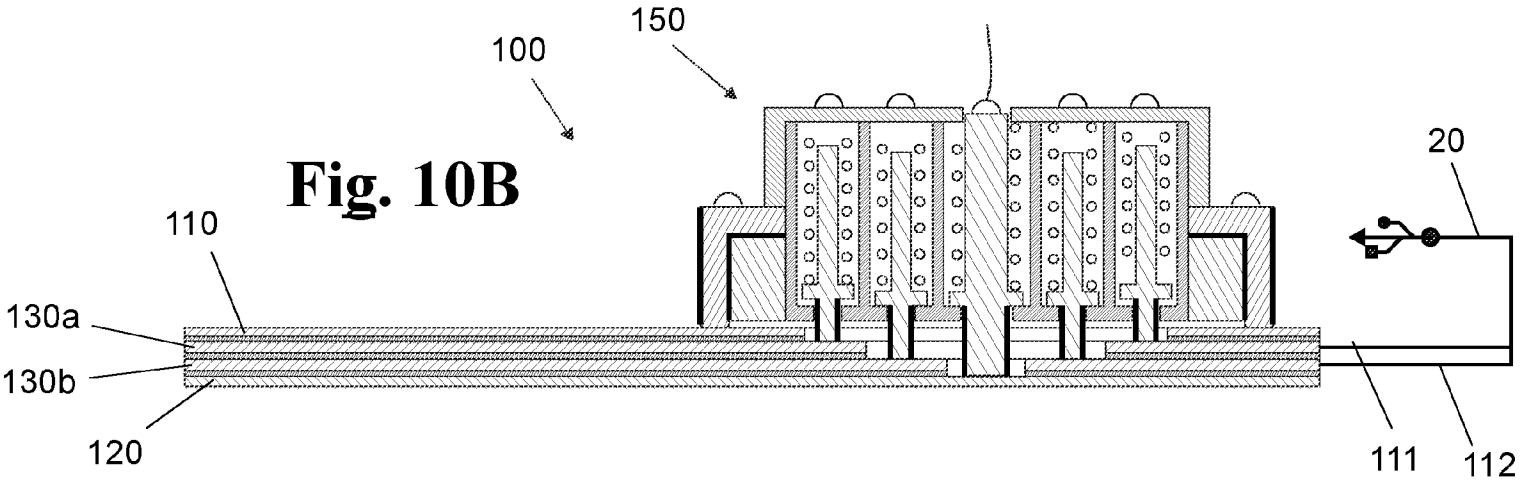
FIG. 10B shows a cross sectional view of an exemplary embodiment of the system for managing electric devices of FIG. 10A, where the electric connection member is centred in a hole.

With reference to FIGS. 9A and 9B, an variant of the exemplary embodiment of FIGS. 8A, 8B and 8C provides that on the panel 110 there are, for example printed, two data transmission lines 111 and 121 arranged to transmit data between an electric device 160 and a network data 20 connected for example to a computer. As said above, it is also possible connecting more devices 160 and put them in connection data to each other and/or with the data circuit 20, and at the same time supply the devices 160. In this exemplary embodiment, the connecting element 150 has a conductor 253 that overlaps the data transmission lines 111 and 121, allowing the device 160 to transmit data with the data circuit 20. In the FIGS. 10A and 10B another variant of the exemplary embodiment of FIGS. 8A, 8B and 8C is shown that provides that the panel 130 comprises two plates 130*a*,130*b* insulated each other, and connected, respectively, to the data transmission lines 111 and 121. This way, the two plates 130*a*,130*b* act as different poles of data transmission, in a similar way as it is carried out with the panels 110 and 120 concerning the transmission of electric current. In this exemplary embodiment, the electric connection member 150 has a fourth conductor 153*a*, in such a way that the third conductor 153 and the fourth conductor 153*a* are connected to the two plates 130*a*,130*b* and therefore to the two data transmission lines 111 and 121.

Figure 11A:
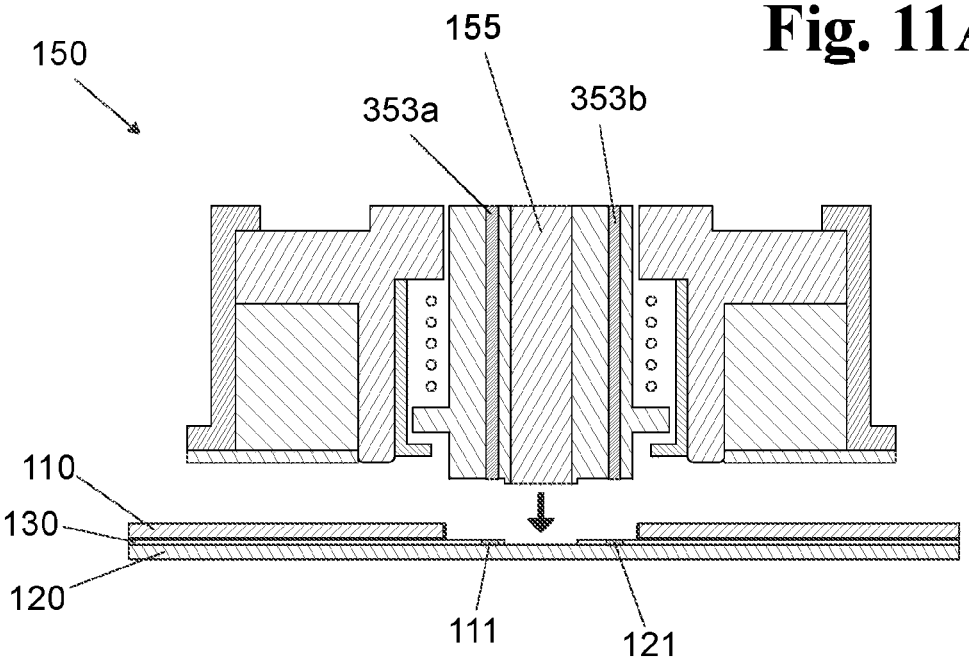
FIGS. 11A and 11B show further exemplary embodiments of the system, wherein alternative systems for data transmission are provided.
Figure 11B:
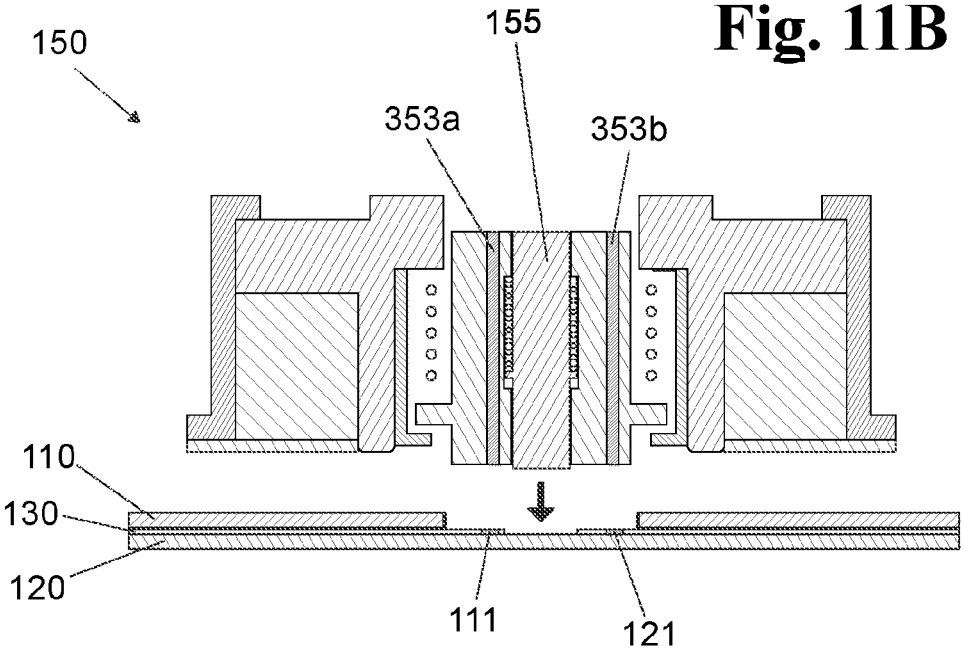

In the FIGS. 11A and 11B a further variant of the exemplary embodiment of FIGS. 8A, 8B and 8C is shown, where the data transmission is made through the conductors 353*a* and 353*b* that touch the data transmission lines 111 and 121. In particular, the exemplary embodiment of FIG. 11A provides that the conductors 353*a* and 353*b* are integral to the conductor 155, whereas the exemplary embodiment of FIG. 11B provides that the conductor 155 can slide between the conductors 353*a* and 353*b* to come in contact with the panel 120 more safely.

Figure 12:
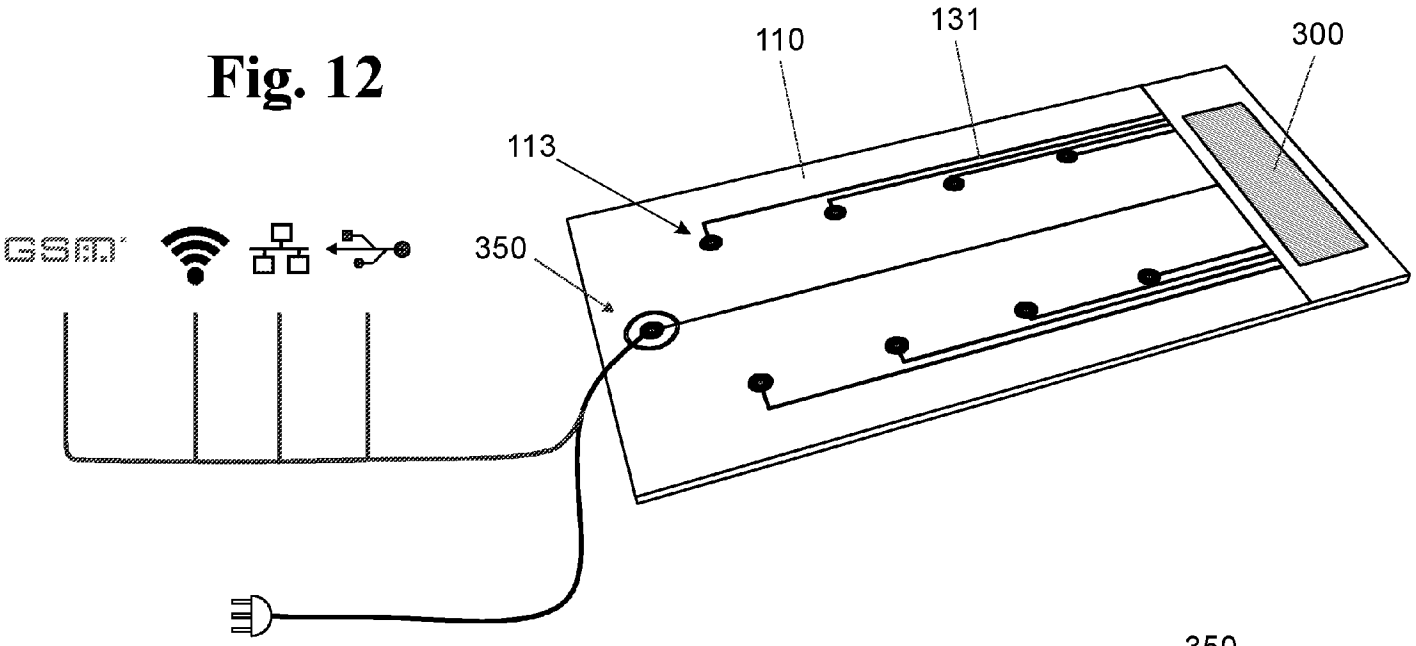
FIG. 12 shows a perspective view of an exemplary embodiment of the system of FIG. 9A, wherein a plug is provided arranged to connect the system to the electric current and to a source of data transmission.

With reference to FIG. 12, in an exemplary embodiment further, the system 100 can provide a display 300 that sums up the status of the sockets (speed of data transmission, status of charge of a device) and that allows scheduling the activation of the system 100.

The data transmission lines 131 can be in parallel or in series, depending on the needs to optimize the amount of data to be transmitted.

Furthermore, a plug 350 can be provided for connecting the system 100 both to the electric network, both to various source data, such as wifi network, ethernet network, GSM network, or USB port of a computer or of a portable device.

Figure 13:
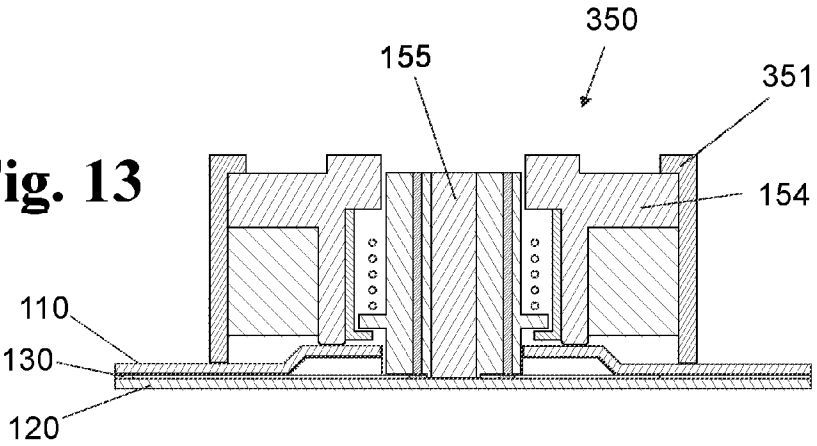
FIG. 13 shows a cross sectional view of the exemplary embodiment to grip of FIG. 12.

The plug 350 can, for example, comprise a connector like that shown in FIG. 13. Such solution allows the plug to connect and disconnect like an electric connection member 150. In this exemplary embodiment, it is provided that the panel 110 is drawn at the holes 113 and that laterally to plug 350 walls 351 are provided arranged to avoid that conductors 154 and 155 can touch at the same time the panel 110. In this case, in fact, since the plug 350 transmits electric current to the system 100, you could have a short-circuit of the electric plant.

Figure 14:
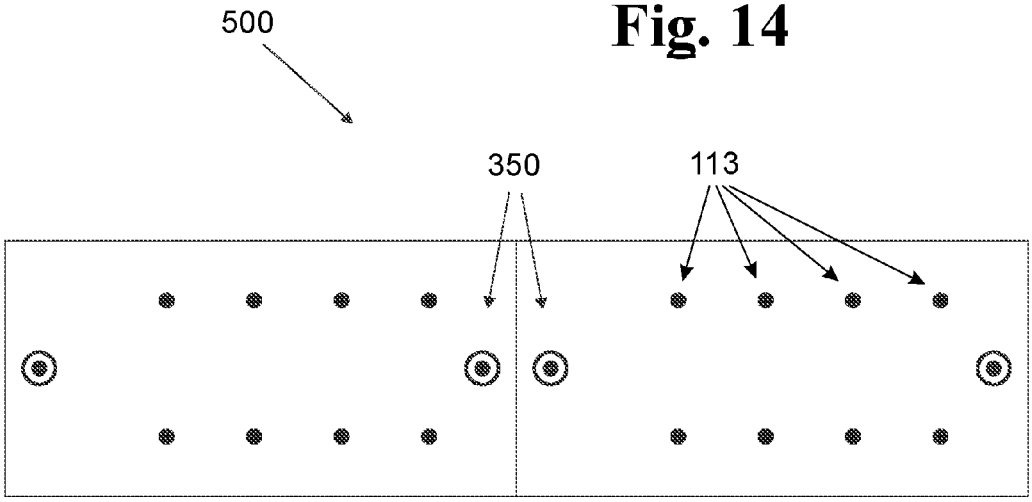
FIG. 14 shows a top plan view of a modular structure made connecting to each other more systems for managing electric devices.
Figure 15:
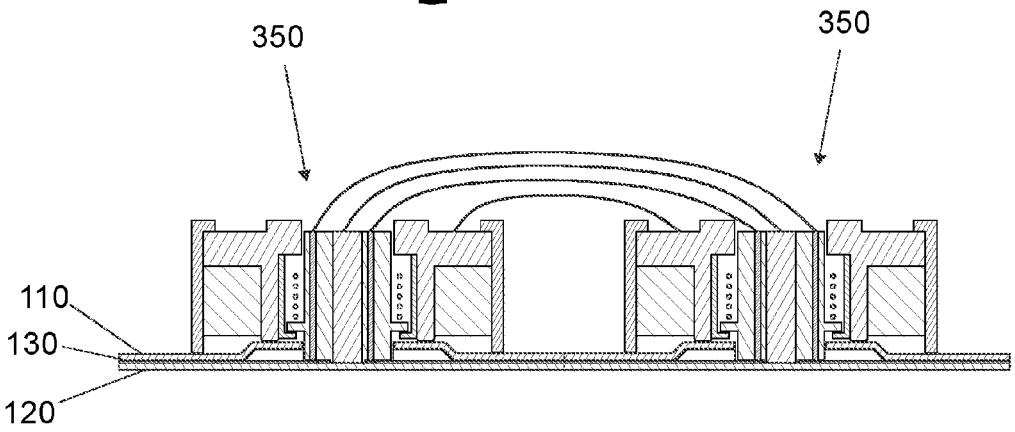
FIG. 15 shows a cross sectional view of the connection between two plugs, in such a way to provide the modular structure of FIG. 14.

With reference to FIGS. 14 and 15, the present invention provides also that the system 100 is electrically connected to other similar systems 100, by the connection of plugs 350, in order to form a modular structure 500. In this case, the panels 110 and 120 of the different systems 100 can be connected each other in parallel or in series depending on the needs, avoiding the presence of wires and cables.

This way, it is possible to make modular structures at will, according to the architectural requirements of the environment where the systems 100 have to be installed.

The present invention provides also the possibility of combining the different exemplary embodiments described above with reference to FIGS. 1 to 15.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realise the different functions described herein could have a different nature without, for this reason, departing from the field of the invention. it is to be understood that the phraseology or terminology that is employed herein is for the purpose of description and not of limitation.

The invention claimed is:

1. A system for managing electric devices, the system comprising:

a first panel having at least one hole and having a first conductor surface defined at least in a neighbouring area of said or each hole, said or each hole being laterally defined by a wall;

a second panel integral and substantially parallel to said first panel, said second panel having a second conductive surface, said first panel being overlapped, in use, to said second panel;

said system being configured in such a way that said second conductive surface has at least one portion not covered by said first panel and accessible through said or each hole;

said first conductive surface and said second conductive surface being connected to an electric circuit in such a way that said first conductive surface has a first predetermined polarity, and said second conductive surface has a second predetermined polarity, opposite to said first predetermined polarity;

said system for managing electric devices further comprises:

at least one electric connection member arranged to electrically connect said first conductive surface and said second conductive surface to an electric device, in such a way to close said electric circuit and electrically supply said electric device;

wherein said first and second panel are made of electrically conductive material;

and wherein said wall is electrically connected to said first conductive surface and is coated by a layer of insulating material arranged to avoid said wall and said second conductive surface from being accidentally electrically connected causing the short circuit of said electric circuit.

2. The system according to claim 1, wherein said first panel is electrically insulated by said second panel by means of an insulating element, said insulating element being an insulating glue arranged to constrain said first and second panel, in such a way to make them integral with one another and arrange them close to each other.

3. The system according to claim 1, wherein a third panel is provided comprising a plurality of holes and integral to said second panel, said third panel located at the opposite side of said first panel with respect to said second panel, in such a way to enable a connection of said or each electric connection member on both the sides of said second panel.

4. The system according to claim 1, wherein at least one fourth panel is provided arranged in parallel to said first and second panel and comprising at least one hole having a diameter that is smaller than the diameter of said or each hole of said first panel, said or each fourth panel comprising at least one data transmission line connected to a data circuit, said data transmission line arranged to be connected with said or each electric connection member, in such a way in order to enable a data transfer from said data circuit to said or each electric device.

5. The system according to claim 4, wherein said or each electric connection member also comprises a third conductor arranged to be connected to said data transmission line to allow that said electric device can transmit data to and/or receive data from said data circuit.

6. The system according to claim 1, wherein at least one among said first panel, said second panel, said third panel, and said fourth panel has at least one portion of magnetizable material, or ferromagnetic material, and said electric connection member comprises a magnet, or an electromagnet, or a ferromagnetic element, in such a way that a magnetic, or electromagnetic, field is generated arranged to constrain said electric connection member to at least one of said panels.

7. The system according to claim 1, wherein said electric connection member comprises:

a first conductor arranged, in use, to be connected with said first conductive surface;

a second conductor arranged to enter in said or in each hole for arranging, in use, in contact with said second conductive surface;

in such a way to electrically connect said electric device to said electric circuit.

8. The system according to claim 7, wherein said or each electric connection member comprises a support structure and said second conductor is slidingly mounted with respect to said support structure, and wherein an elastic element is provided arranged to apply on said second conductor an elastic force for causing a translation of said second conductor with respect to said support structure and to cause the introduction of said second conductor in said or each hole for arranging it in contact with said second conductive surface.

9. The system according to claim 7, wherein said or each electric connection member also comprises a third conductor arranged to be connected to said data transmission line to allow that said electric device can transmit data to and/or receive data from said data circuit.

10. A system for managing electric devices, the system comprising:

a first panel having at least one hole and having a first conductive surface defined at least in a neighbouring area of said or each hole;

a second panel integral and substantially parallel to said first panel, said second panel having a second conductive surface, said first panel being overlapped, in use, to said second panel;

said system being configured in such a way that said second conductive surface has at least one portion not covered by said first panel and accessible through said or each hole;

said first conductive surface and said second conductive surface being connected to an electric circuit in such a way that said first conductive surface has a first predetermined polarity, and said second conductive surface has a second predetermined polarity, opposite to said first predetermined polarity;

said system for managing electric devices comprising furthermore:

at least one electric connection member arranged to electrically connect said first conductive surface and said second conductive surface to an electric device, in order to close said electric circuit and electrically supply said electric device;

wherein a first portion of said first panel and/or a second portion of said second panel has at least one data transmission line connected to a data circuit, said data transmission line arranged to be connected with said or each electric connection member, in such a way to enable a data transfer between said data circuit and said or each electric device.

11. The system according to claim 10, wherein said or each electric connection member also comprises a conductor arranged to be connected to said or each data transmission line to allow that said electric device can transmit data to and/or receive data from said data circuit.

12. The system according to claim 10, wherein said first panel is electrically insulated by said second panel by means of an insulating element, said insulating element being an insulating glue arranged to constrain said first and second panel, in such a way to make them integral with one another and arrange them close to each other.

13. The system according to claim 10, wherein a third panel is provided comprising a plurality of holes and integral to said second panel, said third panel located at the opposite side of said first panel with respect to said second panel, in such a way to enable a connection of said or each electric connection member on both the sides of said second panel.

14. The system according to claim 10, wherein at least one fourth panel is provided arranged in parallel to said first and second panel and comprising at least one hole having a diameter that is smaller than the diameter of said or each hole of said first panel, said or each fourth panel comprising at least one data transmission line connected to a data circuit, said data transmission line arranged to be connected with said or each electric connection member, in such a way in order to enable a data transfer from said data circuit to said or each electric device.

15. The system according to claim 14, wherein said or each electric connection member also comprises a third conductor arranged to be connected to said data transmission line to allow that said electric device can transmit data to and/or receive data from said data circuit.

16. The system according to claim 10, wherein at least one among said first panel, said second panel, said third panel, and said fourth panel has at least one portion of magnetizable material, or ferromagnetic material, and said electric connection member comprises a magnet, or an electromagnet, or a ferromagnetic element, in such a way that a magnetic, or electromagnetic, field is generated arranged to constrain said electric connection member to at least one of said panels.

17. The system according to claim 10, wherein said electric connection member comprises:

a first conductor arranged, in use, to be connected with said first conductive surface;

a second conductor arranged to enter in said or in each hole for arranging, in use, in contact with said second conductive surface;

in such a way to electrically connect said electric device to said electric circuit.

18. The system according to claim 17, wherein said or each electric connection member comprises a support structure and said second conductor is slidingly mounted with respect to said support structure, and wherein an elastic element is provided arranged to apply on said second conductor an elastic force for causing a translation of said second conductor with respect to said support structure and to cause the introduction of said second conductor in said or each hole for arranging it in contact with said second conductive surface.

* * * * *